US007363730B2

(12) United States Patent
Huhtala et al.

(10) Patent No.: US 7,363,730 B2
(45) Date of Patent: Apr. 29, 2008

(54) DEVICES AND METHOD FOR REMOVING BROKEN PULP WEB FROM A PULP DRYER AND MAINTENANCE PLATFORM FOR A PULP DRYER

(75) Inventors: Olli Huhtala, Merimasku (FI); Hannu Kokkala, Turku (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 11/342,044

(22) Filed: Jan. 26, 2006

(65) Prior Publication Data

US 2006/0169428 A1 Aug. 3, 2006

(30) Foreign Application Priority Data

Jan. 31, 2005 (FI) ..... 20050034 U

(51) Int. Cl.
*F26B 19/00* (2006.01)

(52) U.S. Cl. ..... 34/525; 83/53; 162/264

(58) Field of Classification Search ..... 34/525; 83/53; 162/264
See application file for complete search history.

(56) References Cited

U.S. PATENT DOCUMENTS 3,011,733 A 12/1961 Ford
3,620,110 A * 11/1971 Smith ..... 83/66
3,985,074 A * 10/1976 Bonsch ..... 101/410
5,791,067 A * 8/1998 Bendtsen ..... 34/425
5,935,381 A 8/1999 Trokhan et al.
6,402,889 B1 6/2002 Gwosdz-Kaupmann et al.
6,905,573 B2 * 6/2005 Maenpaa et al. ..... 162/199
2004/0129397 A1 * 7/2004 Huhtala et al. ..... 162/193

FOREIGN PATENT DOCUMENTS

WO WO 02/101143 A1 12/2002

* cited by examiner

*Primary Examiner*—S. Gravini
(74) *Attorney, Agent, or Firm*—Cohen Pontani Lieberman & Pavane LLP

(57) ABSTRACT

A device (21) and method for removing a broken pulp web (27) from a pulp dryer and a maintenance platform (23) comprising such a device. The device (21) comprises an actuator (31), a pulling means (33) functionally coupled to the actuator and adapted to be driven by the actuator, and a gripping means (1, 11) coupled to the pulling means (33) and comprising means (4, 5) for engaging to the pulp web. The actuator is arranged to actuate the gripping means via the pulling means. The actuator is used to pull the gripping means and along with it, the pulp web out from the pulp dryer.

16 Claims, 6 Drawing Sheets

DEVICES AND METHOD FOR REMOVING BROKEN PULP WEB FROM A PULP DRYER AND MAINTENANCE PLATFORM FOR A PULP DRYER

BACKGROUND OF THE INVENTION

1. Field of the Invention

The invention relates to devices and a method for removing a broken pulp web from a pulp dryer and to a maintenance platform for a pulp dryer.

2. Description of the Related Art

In a pulp dryer, a web formed of pulp, i.e. the pulp web, is conveyed along a multi-layered path by floating it on an air mattress formed by blowing nozzles. The blowing nozzles are arranged in several superimposed, generally horizontal nozzle levels almost having the length of the pulp dryer. The pulp web is typically introduced in the pulp dryer through its first end. Then the pulp web is conveyed along the uppermost nozzle level of the pulp dryer to the second end of the apparatus. At its ends, the apparatus typically comprises turn rolls, over which the pulp web is turned each time to the next lower nozzle level. When the pulp web has been conveyed to the lowermost nozzle level of the pulp dryer, the pulp web is removed from the pulp dryer, typically through the second end of the pulp dryer. A pulp dryer typically comprises 15 to 30 nozzle levels. The gas blown from the blowing nozzles typically consists of hot air, the blow air generally having a temperature in the range of 120° C. to 170° C. When reaching the pulp dryer, the pulp web typically has a dry solids content of 48% to 54%. The dry solids content of the pulp web leaving the pulp dryer is typically 85% to 95%, usually approximately 90%. The pulp web typically has a width of 3 m. to 9 m. The pulp web is typically conveyed at a speed of 140 to 220 m./min. in the pulp dryer.

The pulp web may break within the dryer for various reasons. In such a situation, the feed of new pulp web into the pulp dryer is interrupted. However, in the case of a web break, there will typically still remain a large amount of pulp web in the pulp dryer, and this web should be removed from the apparatus before the production is restarted.

In the case of a web break, the pulp web is currently removed from the dryer by means of extraction devices fixed to maintenance platforms moving vertically at the first and the second end of the pulp dryer. The extraction device comprises two horizontal rolls transverse to the direction of movement of the pulp web. The rolls are disposed opposite each other so that the nip of the extraction device is formed between them. The rolls are adapted to be rotated by machine force. The pulp web needs to be pulled by muscular force from within the dryer to the nip of the extraction device, and then the pulp web can be extracted by machine force with the aid of the rolls and further guided to a pulper. The distance over which the pulp web needs to be transferred by manpower is typically 2 to 3 meters. After a web break, the wet pulp web remains on the nozzle levels and will have time to dry before cleaning operations are started. Consequently, friction between the nozzle levels and the web will impede cleaning operations, even though nozzle blowing may make the situation somewhat easier. Extraction of the pulp web from the pulp dryer requires strong force. The operation usually requires 2 or 3 operators.

International Patent Application WO 02/101143 discloses a solution, in which a manually moved roll is used for pressing the broken pulp web by manpower against a rotating turn roll. In this manner, a pulling nip is formed between the roll and the turn roll, due to which the pulp web will start moving. This solution also calls for human force. The device of this solution also requires installation work to be done in the inner parts of the pulp dryer.

SUMMARY OF THE INVENTION

The present invention has the purpose of reducing and even eliminating the prior art problems mentioned above.

The present invention has the special purpose of providing a solution for facilitating cleaning operations after a web break in a pulp dryer.

The present invention has especially the purpose of providing a device and method allowing rapid and reliable removal of a broken pulp web from a pulp dryer.

The present invention has especially the purpose of providing a device for removing a broken pulp web from a pulp dryer without calling for permanent installations in the inner parts of the pulp dryer.

The embodiment examples and advantages mentioned herein relate in applicable parts both to the devices of the invention, the pulp dryer maintenance platform and to methods using these devices, even though this is not always separately mentioned.

A typical device of the present invention for removing a broken pulp web from a pulp dryer comprises:

- an actuator, such as a manually driven crank, an electric motor or a pneumatic motor;
- a pulling means functionally coupled to the actuator and adapted to be driven by the actuator. A pulling means includes, for example, a wire rope, a chain, a rope or the like, and also means for pulling the wire rope or the like by means of the actuator. The pulling means may for instance comprise a reel around which the chain is wound;
- a gripping means coupled to the pulling means and comprising means for engaging to the pulp web. Engagement implies that after the gripping means has engaged to the pulp web, i.e., the cellulose web, the pulp web and the gripping means hardly shift relative to each other at the location of the engagement.

A typical actuator of the present invention has been adapted to actuate the gripping means via the pulling means.

A second typical device of the present invention for removing a broken pulp web from a pulp dryer comprises:

- a gripping means as described above, which comprises means for engaging to the pulp web; and
- coupling means for connecting the device to the pulling means, such as, for example, a wire rope, a chain, a rope or a similar means in order to actuate the device via the pulling means. The coupling means may comprise, e.g., a hole or a coupler, into which the wire rope or the chain can be engaged.

A typical pulp dryer maintenance platform of the present invention comprises the device of the present invention for removing a broken pulp web from a pulp dryer. The maintenance platform comprises also means for shifting the maintenance platform to the desired height in the pulp dryer. This allows the broken pulp web to be easily and safely removed from any nozzle levels of the pulp dryer, even from the uppermost levels.

It has now surprisingly been found that the pulp web can be pulled out from the inner parts of a pulp dryer without using strong manual force, by fixing a gripping means to the pulp web and by pulling the gripping means out from the pulp dryer by the force of an actuator. When the pulp web has been extracted to some extent from the pulp dryer with the device of the invention, it can be, for example, guided into a nip between rotating rolls, and then the nip serves for moving the pulp web forward.

One of the advantages of the invention is reducing the amount of manpower needed for removing the pulp web from the pulp dryer. This results in improved working conditions at the mill and easier and faster operations for cleaning the pulp dryer.

The present invention also has the advantage of enabling the gripping means of the present invention to be easily combined with a prior art extraction means comprising rolls.

One embodiment of the present invention comprises at least two gripping means. Owing to these, even a large pulp web can be pulled out from the pulp dryer at a relatively low risk of pulp web rupture.

In one embodiment of the present invention, the pulling means comprises a differential gear, which is disposed to control the traction force between the gripping means. This further reduces the risk of pulp web break.

In one embodiment of the present invention, the pulling means comprises a dummy coupling. The dummy coupling allows a chain or the like to be moved, for example, from a reel to the edge of the web. Such a pulling means or its dummy coupling also comprises a locking means, by means of which a chain or the like is relocked in non-sliding position before the extraction of the pulp web from the pulp dryer is started.

In one embodiment of the present invention, the pulling means comprises a winch with a knob arranged to stop the winch from rotating into one direction when desired. Such a winch can comprise, for example, a helical gear and a locking knob arranged to be set into a locked position with the helical gear. The locking knob is taken off the locked position when the gripping means is pulled to the edge of the pulp web. After the gripping means is engaged to the pulp web the locking knob is set to the locked position. Now the winch can be rotated only into the direction where the web is pulled out from the pulp dryer.

One embodiment of the present invention comprises two adjacent and substantially aligned, generally horizontal rolls. The nip between the rolls can be opened and closed by shifting one roll relative to the other one. Typically at least one of the rolls is driven, so that the pulp web, when extracted from the pulp dryer, can proceed in the process under the driving force of the rolls. The roll actuator is typically, but not necessarily, separate from the actuator intended for pulling the gripping means of the invention.

In one embodiment of the present invention, the means in the gripping means of the invention for engaging to the pulp web comprise a first and a second planar friction means. These planar friction means are disposed to be mutually shifted between at least two positions, i.e., a closed position, in which the planes of the first and the second friction means are arranged substantially in mutual contact, and an open position, in which the planes of the first and the second friction means are arranged substantially separate from each other.

In the closed position, the pulp web is retained between the friction means. In the open position, the pulp web is detached or can be detached from the friction means. The friction means can be hinged, so that in the closed position, the planes of the first and second friction means are aligned and in mutual contact, while in the open position, the planes of the first and the second friction means are at a substantial angle relative to each other. This angle may be, for example, 30° to 60°. A typical planar friction means has an area, for example, in the range of 25-300 cm.$^2$, 25-200 cm.$^2$, 50-300 cm.$^2$, 50-200 cm.$^2$, 75-300 cm.$^2$, 75-200 cm.$^2$ or 75-150 cm.$^2$. It has been proved that planar friction means of roughly this size, when placed against each other, will pull out the pulp web from the pulp dryer at a relatively small risk of pulp web rupture. The planar friction means may naturally also have some other size. The planar plane of the friction means may be mainly straight or curved. The plane may have been formed with various friction-enhancing shapes, such as grooves, recesses, bosses or peaks.

The gripping means of the present invention for engaging to the pulp web may consist of other means than the planar friction means described in this context.

In the case of pulp web break, a method of the present invention comprises following steps:

- interrupting the feed of pulp web into the pulp dryer,
- opening the end doors of a given nozzle level, if necessary,
- shifting the maintenance platform at the end of the pulp dryer to the appropriate height, if necessary,
- opening the nip of the extraction device, if necessary,
- cutting the pulp web through the end door, if necessary,
- shifting the gripping means through the end door opening to the edge of the pulp web, if necessary,
- engaging the gripping means to the edge of the pulp web to be in substantially immobile relative to the pulp web,
- if necessary, adjusting the position of the gripping means in the cross-machine direction,
- using the actuator of the extraction device for removing the pulp web, and along with it, the gripping means from the pulp dryer.

Further possible steps of a method of the present invention include:

- closing the nip of the extraction device so that the extracted pulp web is retained between the nip,
- rotating the rolls of the extraction device so that the pulp web is removed from the pulp dryer under traction of the rolls,
- transferring the pulp web extracted from the pulp dryer to a pulper,
- blowing air from the blowing nozzles in the pulp dryer during the removing of the gripping means and pulp web from the pulp dryer.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
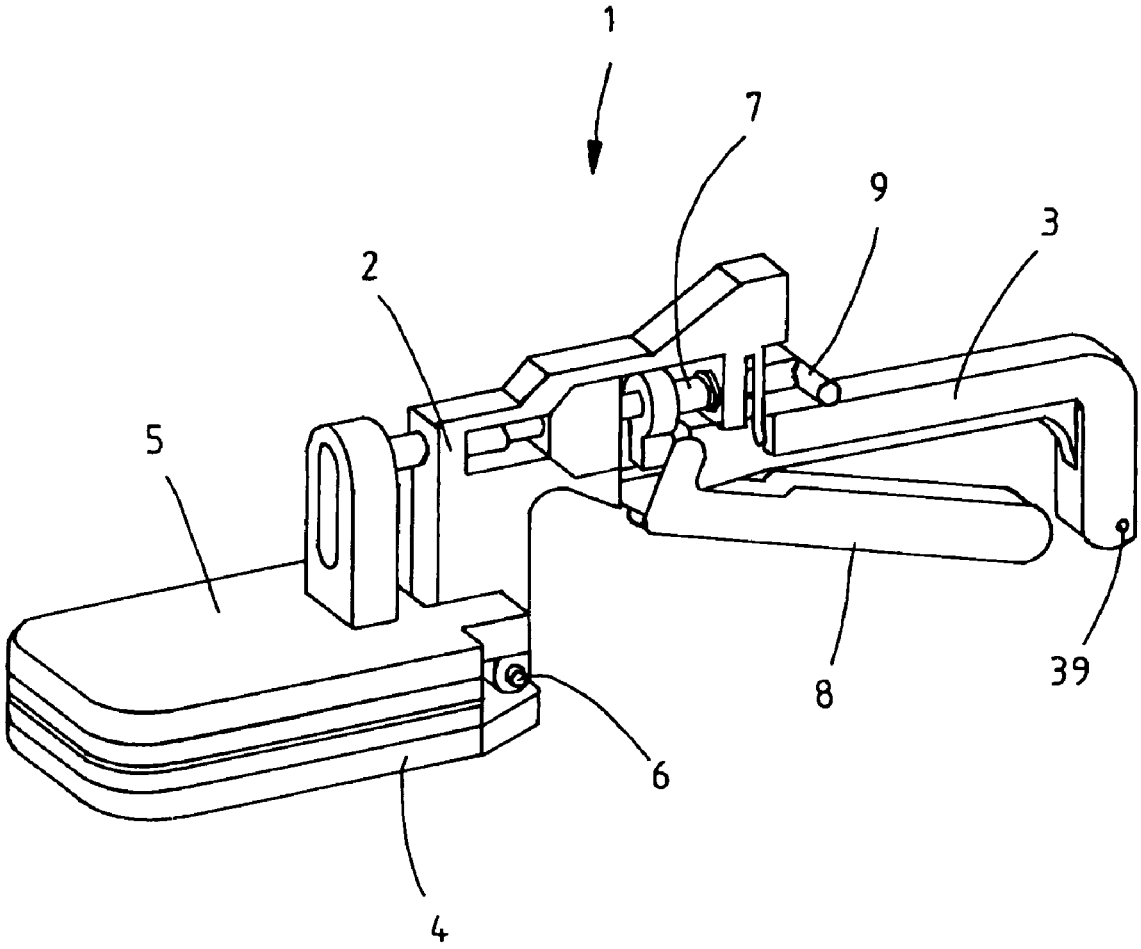
FIG. 1 illustrates the gripping means of the present invention in closed position.

FIG. 1 shows the gripping means 1 of the present invention in closed position. The gripping means 1 has a frame 2 and a handle member 3 and a lower jaw 4 made of the same piece as the frame. The upper jaw 5 is hinged in the frame with a hinge 6. In the illustrated closed position, the upper jaw 5 and the lower jaw 4 of the gripping means are locked to each other. When placed between the closed jaws, a pulp web is not able to move substantially relative to the gripping means. A locking part 7 and a trigger 8 hinged to the frame and an opening button 9 functionally connected to the locking part are also fixed to the frame 2. The locking part 7 communicates with the upper jaw 5 such that, when the trigger 8 is pressed, the jaws 4 and 5 are pressed against each other. The jaws 4 and 5 are opened, i.e., the gripping means is brought into open position, by pressing the opening button 9. The particulars of the locking and opening mechanisms of the type described above do not constitute the object of this invention, and hence they are not explained in further detail here. The locking and opening mechanisms can be devised separately as necessary. The handle part 3 at the second end of the frame comprises an opening 39, to which a wire rope, a chain or other means can engage for pulling the gripping means 1.

Figure 2:
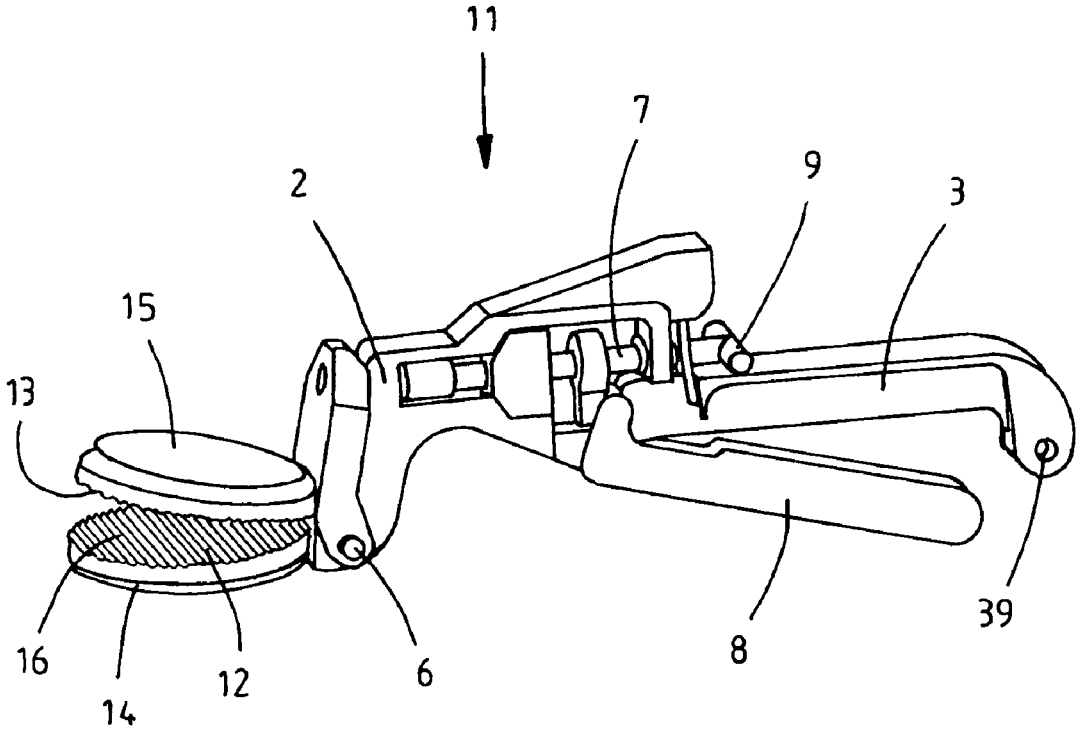
FIG. 2 illustrates a second gripping means of the present invention in open position.
Figure 3:
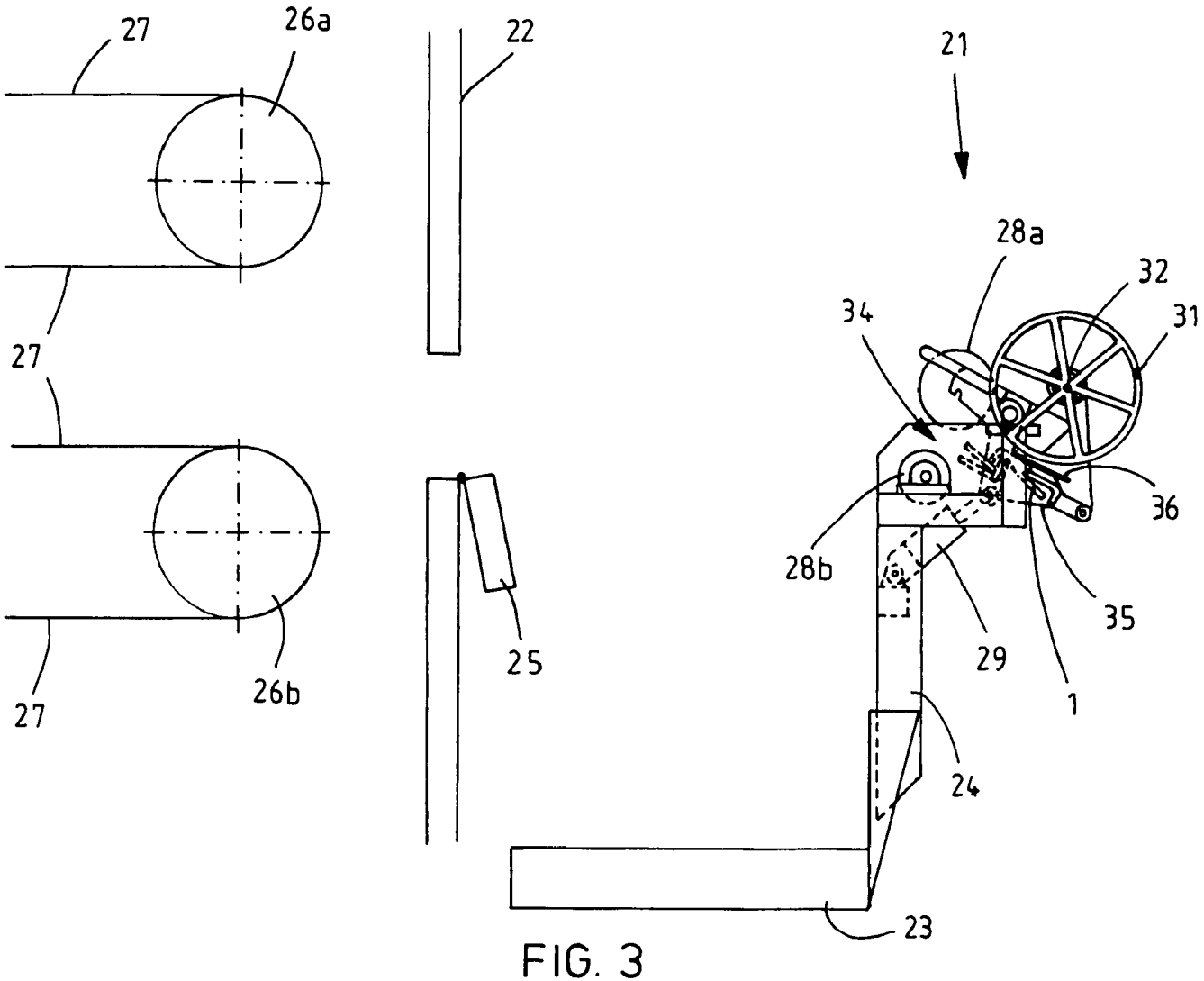
FIG. 3 illustrates a device of the present invention when the gripping means is at its storage location.
Figure 4:
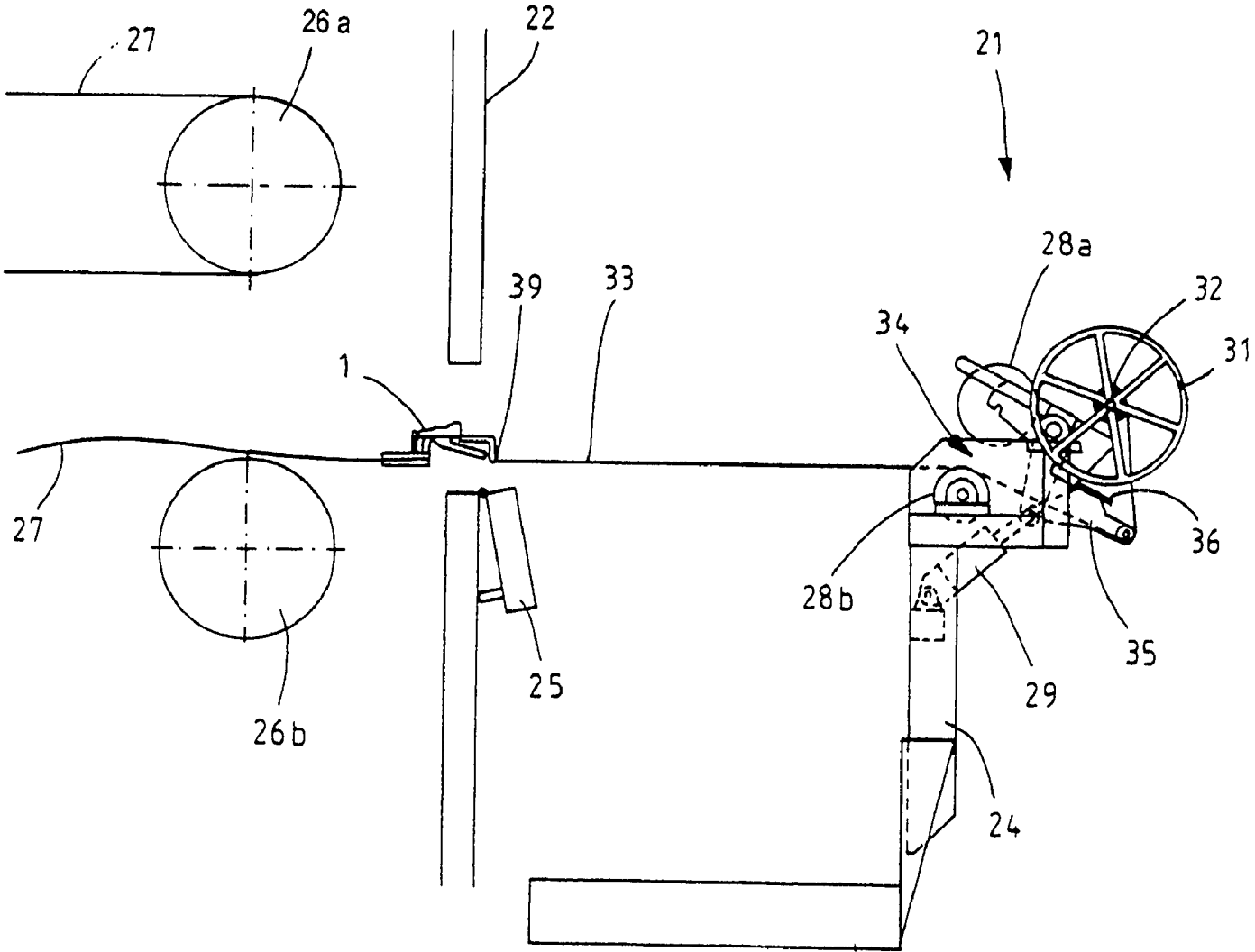
FIG. 4 illustrates a device of the present invention when the gripping means is engaged to the pulp web.
Figure 5:
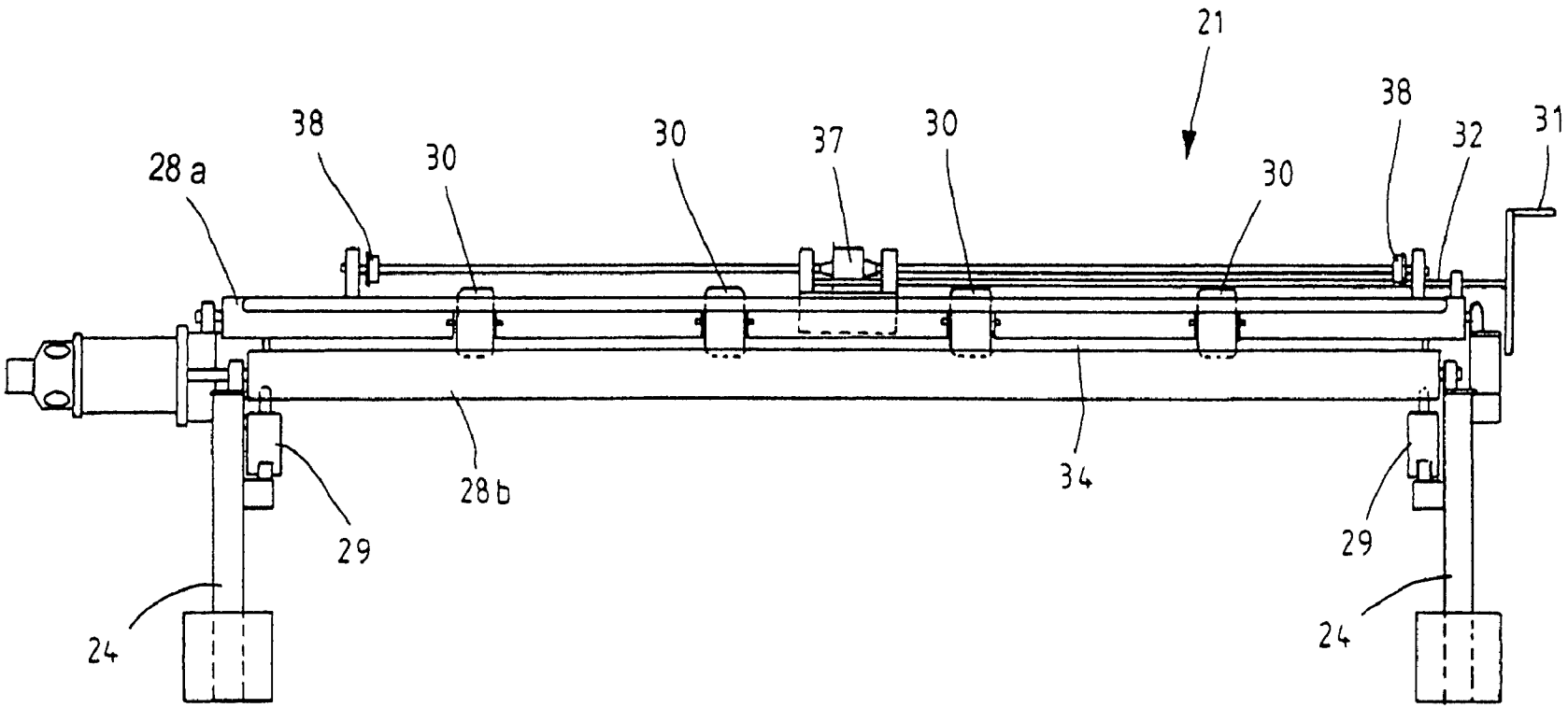
FIG. 5 is a front view of the device of the present invention.
Figure 6:
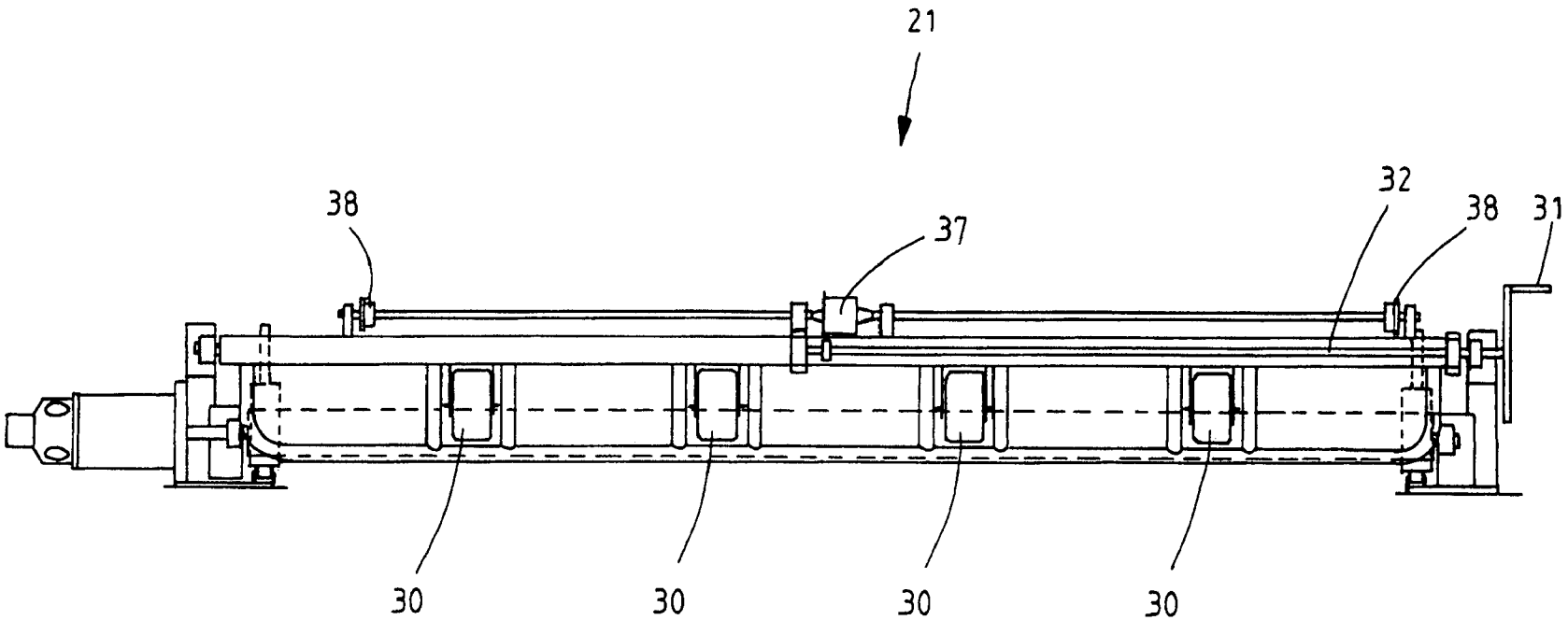
FIG. 6 is a top view of the device of the present invention.

FIG. 2 shows a second embodiment 11 of the gripping means of the present invention, which mainly corresponds to the gripping means of FIG. 1, yet with the lower jaw 14 and the upper jaw 15 differently shaped than in FIG. 1. The gripping means 11 in FIG. 2 is in open position, i.e., the upper jaw 15 and the lower jaw 14 are at an angle. The pulp web can now be placed between the jaws 14, 15. FIG. 2 shows how the surface 12 of the lower jaw 14 and the surface 13 of the upper jaw 15 fitted against this are equipped with matching teeth or grooves 16 in order to achieve enhanced engagement between the gripping means 11 and the pulp web. The friction surfaces 12 and 13 of the gripping means typically have an approximate area of 100 $cm.^2$ FIGS. 3 to 6 illustrate the pulp web extraction device 21 of the present invention. The extraction device 21 is fixed by support legs 24 to a maintenance platform 23 located outside the rear wall 22 of the pulp dryer at the second end of the pulp dryer. In a typical pulp dryer of the present invention, the device of the present invention is mounted at both ends of the pulp dryer. The maintenance platform 23 is typically disposed to be vertically movable. The rear wall 22 has a plurality of doors 25, one of which is opened in the illustrated situation. For the sake of clarity, only two turn rolls 26*a* and 26*b* of the pulp dryer are shown in FIG. 3. FIG. 3 also shows the pulp web 27, which rotates around both the turn rolls 26*a*, 26*b*, passing all the way to the first end (not shown) of the pulp dryer between the turn rolls. FIG. 5 is a front view of the extraction device 21, i.e., viewed from the direction of the pulp dryer 26*a*, 26*b*. FIG. 6 is a top view of the extraction device 21.

The extraction device 21 comprises two rolls 28*a* and 28*b*, and the nip 34 between them can be either opened or closed by shifting the upper roll 28*a* relative to the lower roll 28*b* by means of a hydraulic or pneumatic cylinder 29. Four rubber wheels 30 are fixed to the upper roll 28*a*. The extraction device 21 also comprises a shaft 32 rotatable by a crank 31, with a chain 33 in the situation of FIG. 3, wound around the shaft 32. The chain 33 is shown in FIG. 4. The chain 33 is fixed in the opening 39 provided in the gripping means 1.

In the case of a web break, the feed of pulp web 27 to the pulp dryer is interrupted. At its second end, the pulp dryer typically comprises openable end doors 25 at each nozzle level. The end doors 25 of a given nozzle level are opened. The maintenance platform 23 moving vertically at the other end of the pulp dryer is shifted to a height such that the pulp web 27 to be removed is roughly at the height of the chest of a cleaning operator standing on the maintenance platform 23. The openable rolls 28*a* and 28*b* of the extraction device are shifted to a distance from each other, in other words, the nip 34 of the extraction device 21 is opened. The extraction device 21 is in the situation illustrated in FIG. 3. The pulp web 27 is cut with a knife roughly at the location of the turn roll 26*b* visible through the end door 25.

The cleaning operator then connects the dummy coupling 38 of the extraction device 21, allowing the chain 33 to be wound out. The cleaning operator grips the gripping means 1 and takes it through the nip 34 and further through the opening in the end door 25 to the edge of the pulp web 27. FIG. 4 illustrates this situation. The gripping means 1 is opened and closed, i.e., locked substantially immobile relative to the pulp web at the edge of the pulp web 27. Then, the dummy coupling 38 is locked so as to allow the chain 33 and the engaged gripping means 1 to be extracted from the pulp dryer. The same steps are typically carried out for the second corresponding gripping means 1. There may be more than two gripping means. The cross-machine position of the gripping means may be adjustable. Instead of the dummy coupling, the extraction device 21 could comprise a winch and a locking knob arranged to lock and release the winch when wanted.

Next, the cleaning operator passes to the side of the pulp dryer, outside the web area. He turns the handle crank 31 of the extraction device, pulling the chain 33, the engaged gripping means 1 and thus also the pulp web 27 out from the pulp dryer into the open nip 34 of the extraction device 21. The crank 31 of the extraction device can be replaced with a motor, such as an electric motor and its controllers, for instance.

Shortly before the pulling is ended, the nip 34 of the extraction device is closed by means of the cylinders 29. This is intended to ensure that the end of the pulp web 27, when pulled out of the pulp dryer, does not flow down on the maintenance platform 23 when the grip of the gripping means 1 is released from the edge of the pulp web 27 one moment later. At the end of the pulling movement, the gripping means is taken to the storage location 35 intended for it. The storage location 35 is provided with a pin 36, which is disposed to hit and fit exactly the opening button 9 of the gripping means entering the storage location. As it enters the storage location 35, the gripping means 1 will thus be released automatically, so that the engagement of the gripping means with the edge of the pulp web 27 is released. FIG. 3 shows the gripping means 1 in its storage location 35. When the rolls 28*a* and 28*b* of the extraction device are now rotated in the appropriate direction, the pulp web 27 is removed from the pulp dryer under the traction of the rolls 28*a* and 28*b*. When pulled out from the pulp dryer, the pulp web 27 is taken to the pulper.

The extraction device 21 comprises a differential gear 37, thus ensuring that the traction force is transferred to the side of the gripping means 1 where the resistance is lower. The differential gear 37 ensures faultless traction all the way to the end, even if the gripping means 1 tended to reach their storage locations at different times.

The figures illustrate but one preferred embodiment of the present invention. They do not separately show issues that are secondary in terms of the main idea of the present invention and known per se to those skilled in the art.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A device for removing a broken pulp web from a pulp dryer, comprising:

a gripping means operable to engage a portion of the broken pulp web;

a coupling means operable for connecting the device to a pulling means in order to shift the device by means of the pulling means, wherein the pulling is functionally coupled to an actuator and is configured to be driven by the actuator and is operable to control a pulling force exerted by the gripping means upon a portion of the web; and two adjacent and substantially aligned rolls, and whereby a nip formed between the rolls can be opened and closed by shifting one roll relative to the other, wherein the pulling means pulls the gripping means and the portion of the broken pulp web gripped by the gripping means through the nip.

2. The device of claim 1, wherein the device comprises at least two gripping means.

3. The device of claim 1, further comprising a dummy coupling for shifting the gripping means towards the pulp web.

4. The device of claim 1, further comprising a winch with a locking knob operable to stop the winch from rotating into one direction when desired.

5. The device of claim 1, wherein the gripping means comprises a first and a second planar friction means arranged to be shifted between at least a closed position and an open position, in the closed position, planar surfaces of the first and the second friction means are disposed substantially in mutual contact, and in the an open position, the planar surfaces of the first and the second friction means are disposed substantially separate from each other.

6. A maintenance platform for a pulp dryer, comprising:

a frame;

a means for shifting the frame vertically to a desired height; and a device for removing a broken pulp web from a pulp dryer, the device being fixed to the frame, the device comprising:

an actuator;

a differential gear functionally coupled to the actuator and configured to be driven by the actuator; and a gripping means coupled to the pulling means and comprising means for engaging a portion of the pulp web;

wherein the actuator is arranged to actuate the gripping means via the differential gear which is operable to control a pulling force exerted by the gripping means upon a portion of the web.

7. The device of claim 1, wherein the differential gear pulls the gripping means and the portion of the broken pulp web gripped by the gripping means through the nip.

8. The device of claim 7, wherein the differential gear pulls the gripping means to a storage location in which the gripping means releases the broken pulp web.

9. The device of claim 8, wherein the rolls are arranged and dimensioned to pull the broken pulp web from the pulp dryer after the broken pulp web is pulled through the nip by the gripping means.

10. The maintenance platform of claim 6, further comprising two adjacent and substantially aligned rolls, and whereby a nip formed between the rolls can be opened and closed by shifting one roll relative to the other, wherein the differential gear pulls the gripping means and the portion of the broken pulp web gripped by the gripping means through the nip.

11. The maintenance platform of claim 10, wherein the differential gear pulls the gripping means to a storage location in which the gripping means releases the broken pulp web.

12. The maintenance platform of claim 11, wherein the rolls are arranged and dimensioned to pull the broken pulp web from the pulp dryer after the broken pulp web is pulled through the nip by the gripping means.

13. The maintenance platform of claim 6, wherein the device comprises at least two gripping means.

14. The maintenance platform of claim 6, further comprising a dummy coupling for shifting the gripping means towards the pulp web.

15. The maintenance platform of claim 6, further comprising a winch with a locking knob operable to stop the winch from rotating into one direction when desired.

16. The maintenance platform of claim 6, wherein the gripping means comprises a first and a second planar friction means arranged to be shifted between at least a closed position and an open position, in the closed position, planar surfaces of the first and the second friction means are disposed substantially in mutual contact, and in the an open position, the planar surfaces of the first and the second friction means are disposed substantially separate from each other.

* * * * *